United States Patent [19]

Price, Jr. et al.

[11] Patent Number: 4,972,962

[45] Date of Patent: Nov. 27, 1990

[54] APPARATUS FOR STACKING COMPUTER CONTROL UNITS

[75] Inventors: Macy J. Price, Jr., Louisville; Daniel C. Starkey, Englewood, both of Colo.

[73] Assignee: Engineered Data Products, Inc., Broomfield, Colo.

[21] Appl. No.: 342,127

[22] Filed: Apr. 24, 1989

[51] Int. Cl.[5] ..... A47B 47/00

[52] U.S. Cl. ..... 211/194; 206/821; 248/918

[58] Field of Search ..... 211/194, 59.4, 26; 248/917, 918, 924; 206/821, 509, 515–518

[56] References Cited

U.S. PATENT DOCUMENTS

| | | | |
|---|---|---|---|
| 1,747,408 | 2/1930 | Warren | 206/821 X |
| 2,320,388 | 6/1943 | Shaw | 211/194 X |
| 2,557,630 | 6/1951 | Brown | 206/821 X |
| 3,502,237 | 3/1970 | Verhein et al. | 206/821 X |
| 3,595,513 | 7/1971 | Rehlaender | 248/917 X |
| 3,704,792 | 12/1972 | Wiese | 211/194 X |
| 4,497,411 | 2/1985 | De Bortoli | 211/26 |
| 4,620,636 | 11/1986 | Herr et al. | 211/194 X |
| 4,660,725 | 4/1987 | Fishman et al. | 206/509 |
| 4,681,378 | 7/1987 | Hellman, III | 211/194 X |

FOREIGN PATENT DOCUMENTS

| | | | |
|---|---|---|---|
| 1416227 | 4/1974 | United Kingdom | 211/59.4 |
| 2167044 | 5/1986 | United Kingdom | 206/509 |

*Primary Examiner*—David L. Talbott
*Assistant Examiner*—Daniel Hulseberg
*Attorney, Agent, or Firm*—Klaas & Law

[57] ABSTRACT

Apparatus for stacking one computer control unit of a certain type on top of another computer control unit of the same type comprising a plurality of walls which are secured together to form a frame having a central opening. Each of the walls has an outer surface, an inner surface, a top side and a bottom side. Reinforcing members are secured to at least a plurality of the inner surfaces for adding strength to the open frame. The reinforcing members have a top surface and a bottom surface so that the open frame may be positioned over the top portion of one computer control unit so that the bottom surface contacts at least a portion of the one computer control unit and the other computer control unit may be positioned on the top surface of the reinforcing members. All of the components are formed from metal and are secured together in the desired relationship by welding.

9 Claims, 5 Drawing Sheets

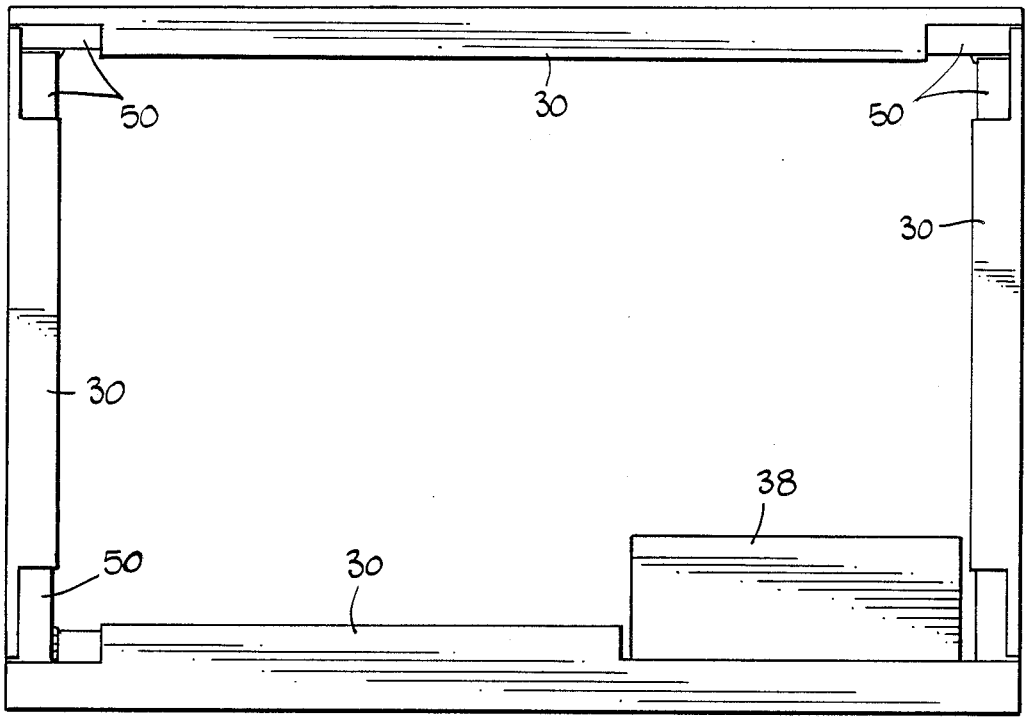
FIG. 2
FIG. 3
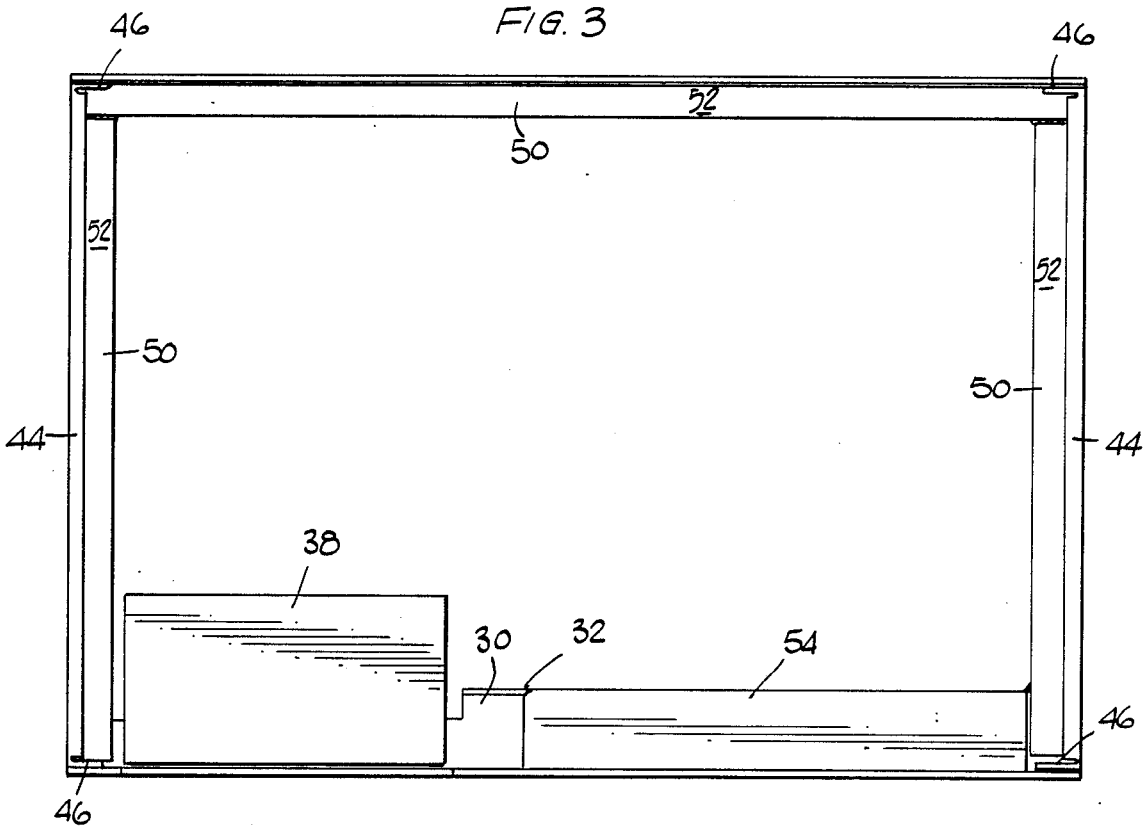

APPARATUS FOR STACKING COMPUTER CONTROL UNITS

FIELD OF THE INVENTION

This invention relates generally to the provision of furniture for use in business establishments using computer control units and more particularly to the provision of apparatus for use in stacking computer control units on top of each other to conserve space.

BACKGROUND OF THE INVENTION

The use of computers in today's business establishments is constantly growing. As a result of this growth, it has become increasingly necessary to provide some type of apparatus for conserving space and at the same time accommodate more computer control units. Apparatus has been provided for stacking computer control units of the same type one on top of another. The foregoing apparatus has been constructed from wood and is expensive and not readily reproducible. Thus, there exists a need for a stacker for computer control units that is strong and readily reproducible.

BRIEF DESCRIPTION OF THE INVENTION

This invention provides apparatus for use in stacking one computer control unit of a certain type on top of another computer control unit of the same type that is constructed by welding together various metallic sections.

In one preferred embodiment of the invention, the apparatus comprises a frame having a central opening which frame comprises front and back walls and two opposite sidewalls. The walls are secured together to form the open frame and each wall has an outer surface, an inner surface, a top side and a bottom side. Reinforcing means are secured to at least a plurality of the inner surfaces for adding strength to the open frame which reinforcing means has at least a top surface and a bottom surface so that, when in use, the bottom surface is in contact with at least a portion of one computer control unit and the top surface is in contact with a portion of another computer control unit. The walls and the reinforcing means are formed from metal, such as sheet steel. The reinforcing means comprise an inwardly directed integral flange projecting from the top side of each of the walls, a plurality of channel members each of which is secured to the inner surface of each of the walls at a location between the top side and the bottom side and at least one post extends between and is secured to an associated flange and channel member.

In another preferred embodiment of the invention, the reinforcing means comprises an angle member secured to the inner surface of the front wall which angle member has a length substantially the same as the length of the front wall, a channel member secured to the inner surface of each of the two sidewalls and having a length substantially the same as the length of the sidewall and a flange projecting inwardly from the top side of the back wall and having a length substantially the same as the length of the back wall. As described above, the walls and the reinforcing means are formed from metal.

BRIEF DESCRIPTION OF THE DRAWINGS

Illustrative and presently preferred embodiments of the invention are shown in the accompanying drawings in which:

FIG. 2 is a top plan view of FIG. 1;

FIG. 3 is a bottom plan view of FIG. 1;

DETAILED DESCRIPTION OF THE INVENTION

Figure 1:
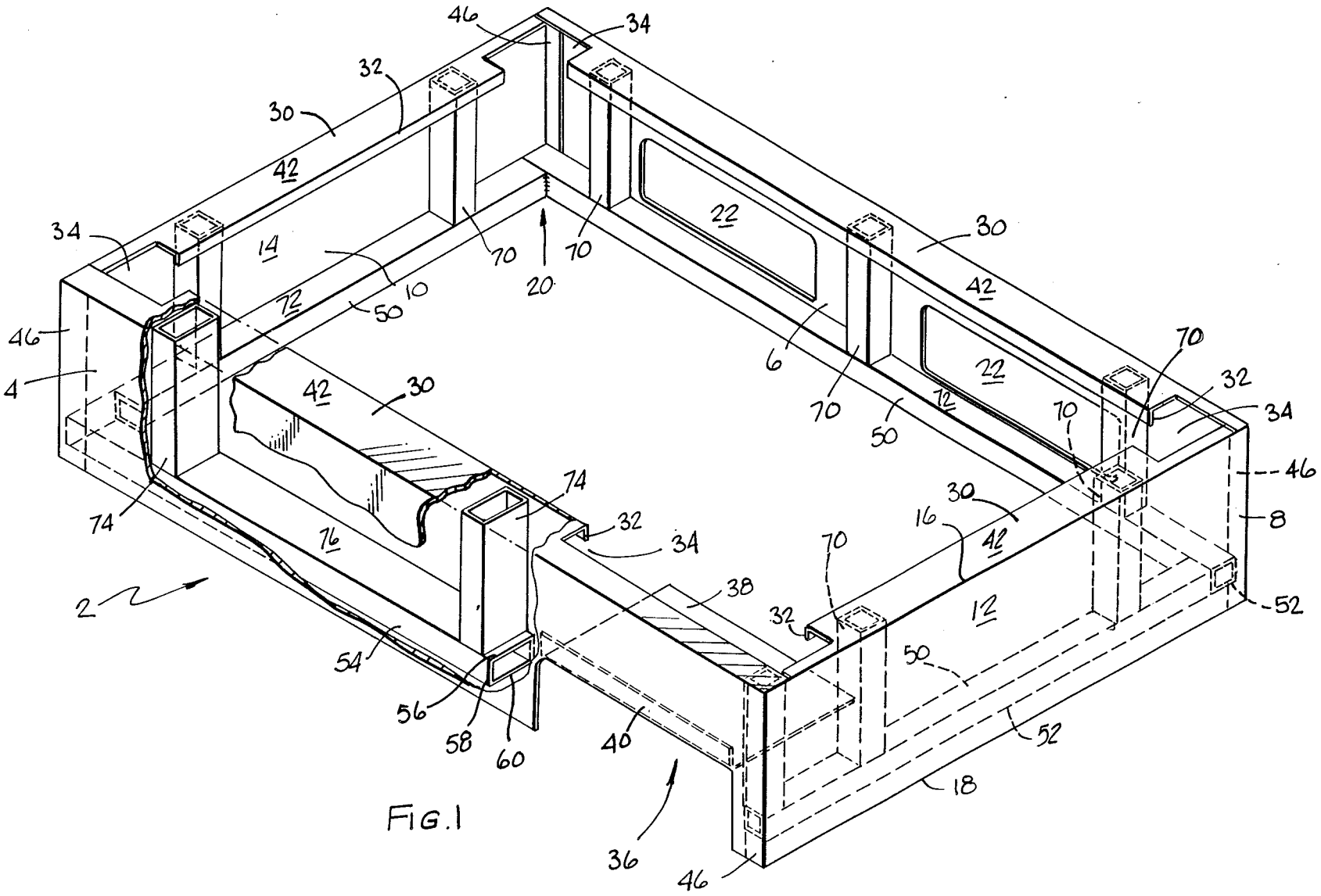
FIG. 1 is a perspective view of one preferred embodiment of the invention.
Figure 4:
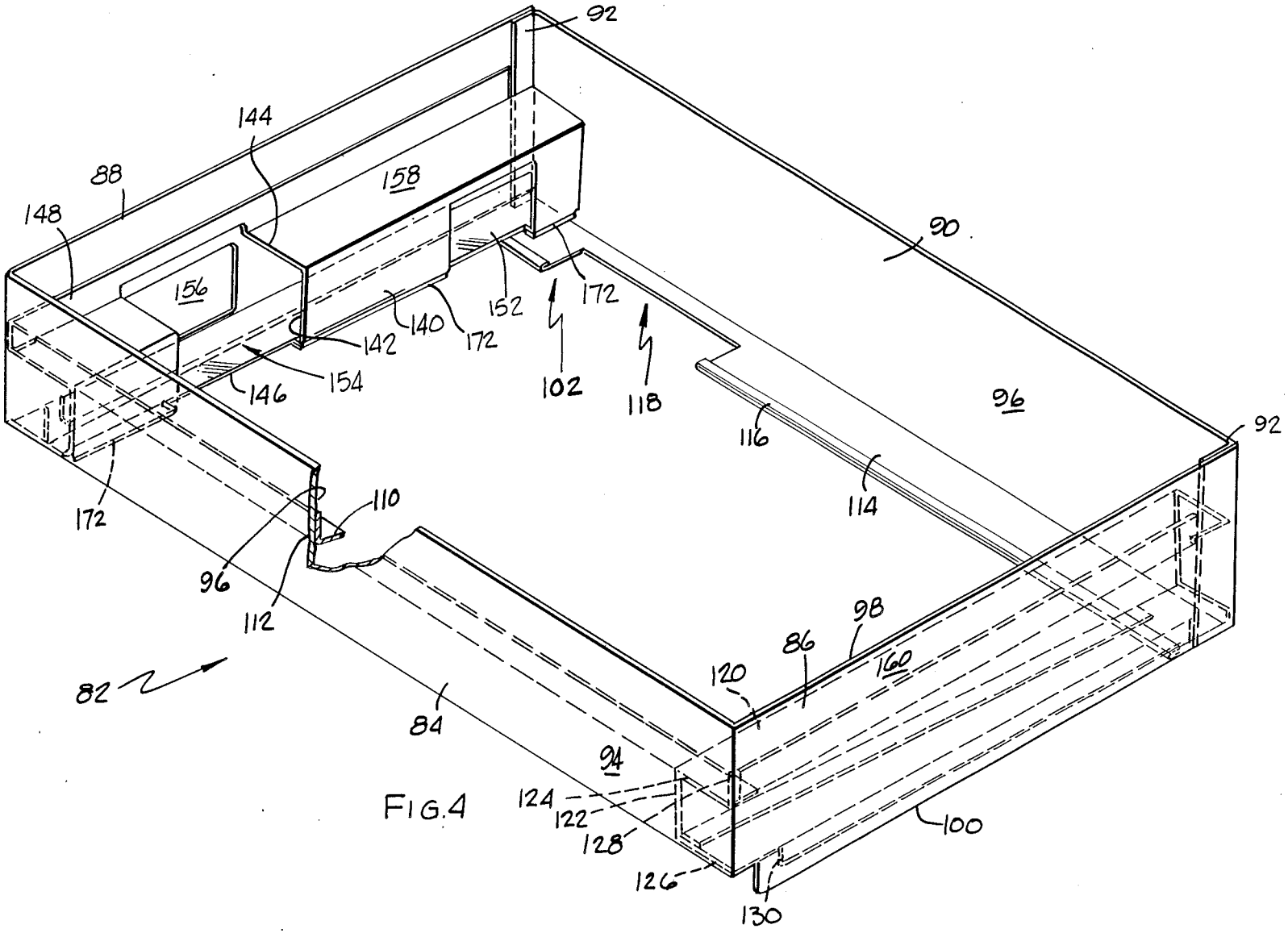
FIG. 4 is a perspective view of another preferred embodiment of the invention.

In FIGS. 1–3, there is illustrated one preferred embodiment of the invention which comprises a stacker unit 2 having a front wall 4, a back wall 6 and two opposite sidewalls 8 and 10 all of which, as described above, are preferably formed of metal, such as sheet steel. Each of the walls has an outer surface 12, identified on sidewall 8, an inner surface 14, identified on sidewall 10, a top side 16 and a bottom side 18. Reinforcing means 20 are provided on the inner surfaces 14 of the walls. Two access openings 22 are formed in the back wall 6.

The reinforcing mean 20 includes an inwardly directed integral flange 30 which projects inwardly from the top sides 16 of the front wall 4, the back wall 6 and the sidewalls 8 and 10. An integral lip portion 32 projects downwardly from the flanges 30. A cut out portion 34 is formed from the flanges 30 so that the legs of a computer control unit may pass therethrough when it is supported on the flanges 30. The flange 30 on the front wall 4 has a width greater than the other flanges 30. An opening 36 is formed in the front wall 4 and a reinforcing plate 38 is secured to the inner surface 14 by welding a lip portion 40 thereof to the inner surface 14 of the front wall 4. The flanges 30 on the sidewalls 8 and 10 have a length that is shorter than the length of the sidewalls 8 and 10 to provide spaces for the flanges 30 on the front wall 4 and the back wall 6 so that the outer surfaces 42 thereof are generally planar and lie in a common plane. A short flange 44, FIG. 3, projects inwardly from the bottom sides of the sidewalls 8 and 10. Integral flanges 46 extend inwardly from the ends of the sidewalls 8 and 10 and are secured to the front wall 4 and the back wall 6.

Another portion of the reinforcing means 30 comprises a plurality of channel members 50 which are secured to the inner surfaces 14 of the back wall 6 and the sidewalls 8 and 10. The channel members 50 have a transverse cross-sectional configuration that is square. Each of the channel members 50 have a bottom surface 52 that is spaced a short distance above the bottom sides 18 of the back wall 6 and sidewalls 8 and 10. The channel members 50 are secured to each other at their junctions and to the sidewalls 8 and 10 and the back wall 6 by welding. Another channel member 54 is secured on the inner surface 14 of the front wall 4 and has a rectangular transverse cross-sectional configuration having length 56 greater than its width 58. The channel member 54 has a bottom surface 60 that is spaced above the bottom side 18 of the front wall 4. The bottom surfaces 60 and 58 are generally planar and lie in a common plane. The bottom surfaces 52 and 60 are adapted to be placed on the top portion of a computer control unit.

A plurality of posts 70 extend between and are secured to the upper surfaces 72 of the channel members 50 and to the lower surfaces of the flanges 30. Each post 70 has a transverse cross-sectional configuration that is square and is the same in size as the transverse cross-sectional configuration of the channel members 50. The posts 70 are secured to the channel members 50, the flanges 30, the back wall 6 and sidewalls 8 and 10 by welding. Another plurality of posts 74 extend between and are secured to the upper surface 76 of the channel member 54 and the bottom surface of the flange 30 by welding. Each post 74 has a rectangular transverse cross-sectional configuration which is the same in size as the rectangular transverse cross-sectional configuration of the channel member 54.

In operation, the stacker unit 2 is placed over the top portion of a computer control unit so that the bottom surfaces 52 and 58 are in contact therewith. The portions of the front wall 4 below the channel member 54, the back wall 6 below the channel member 50 and the flanges 44 function to hold the stacker unit 2 on the computer control unit. Another computer control unit is then placed on the stacker unit 2 with the legs thereof passing through the cut out portions 34 and the bottom portion thereof seated on the outer surfaces 42. In FIGS. 4–8, there is illustrated another preferred embodiment of the invention which comprises a stacker unit 82 having a front wall 84 having two integral sidewalls 86 and 88 extending perpendicularly therefrom. A back wall 90 has end flanges 92 which are secured to the sidewalls 86 and 88 by welding. Each of the walls, all of which, as described above, are preferably formed from metal, such as sheet steel has an outer surface 94, identified on front wall 84, an inner surface 96, identified on back wall 90, a top side 98 and a bottom side 100. Reinforcing means 102 are provided on the inner surfaces 96 of the walls.

The reinforcing means 102 include an angle member 110 having one side 112 thereof secured to the inner surface 96 of the front wall 84 by welding. A lengthwise extending reinforcing flange 114 projects inwardly from the bottom side 100 of the back wall 90 and has an end portion 116 folded back so as to form a double thickness. A cut out portion 118 forms an access opening in the reinforcing flange 114.

Another portion of the reinforcing means 102 includes a channel member 120 secured to sidewall 86 and having at least three walls in a generally U-shaped arrangement comprising a base member 122 and two integral leg members 124 and 126 extending outwardly in a perpendicular direction therefrom. The base member 122 and the leg members 124 have generally planar surfaces. A flange member 128 extends outwardly in a perpendicular direction from the leg member 124 and a flange member 130 extends outwardly in a perpendicular direction from the leg member 126. The flange members 128 and 130 have generally planar surfaces with one surface of each being secured to the inner surface 96 of the sidewall 86 by welding. The cross-sectional configuration of the channel member 120 is smaller next adjacent to the front wall 84 than its cross-sectional configuration next adjacent to the back wall 90.

The reinforcing means 102 also include a channel member 140 secured to the sidewall 88 and having at least three walls in a generally U-shaped arrangement comprising a base member 142 and two integral leg members 144 and 146 extending outwardly in a perpendicular direction therefrom. The base member 142 and the leg members 144 and 146 have generally planar surfaces. A flange member 148 extends outwardly in a perpendicular direction from the leg member 144 and a flange member 150 extends outwardly in a perpendicular direction from the leg member 146. The flange members 148 and 150 have generally planar surfaces with one surface of each being secured to the inner surface 96 of the sidewall 88 by welding. The cross-sectional configuration of the channel member 140 is smaller next adjacent to the front wall 84 than its cross-sectional configuration next adjacent to the back wall 90. The channel member 140 has access openings 152 and 154 formed therein with the access opening 154 being located to cooperate with an access opening 156 formed in the sidewall 88. The access opening 152 is located to cooperate with the cut out portion 118.

Figure 5:
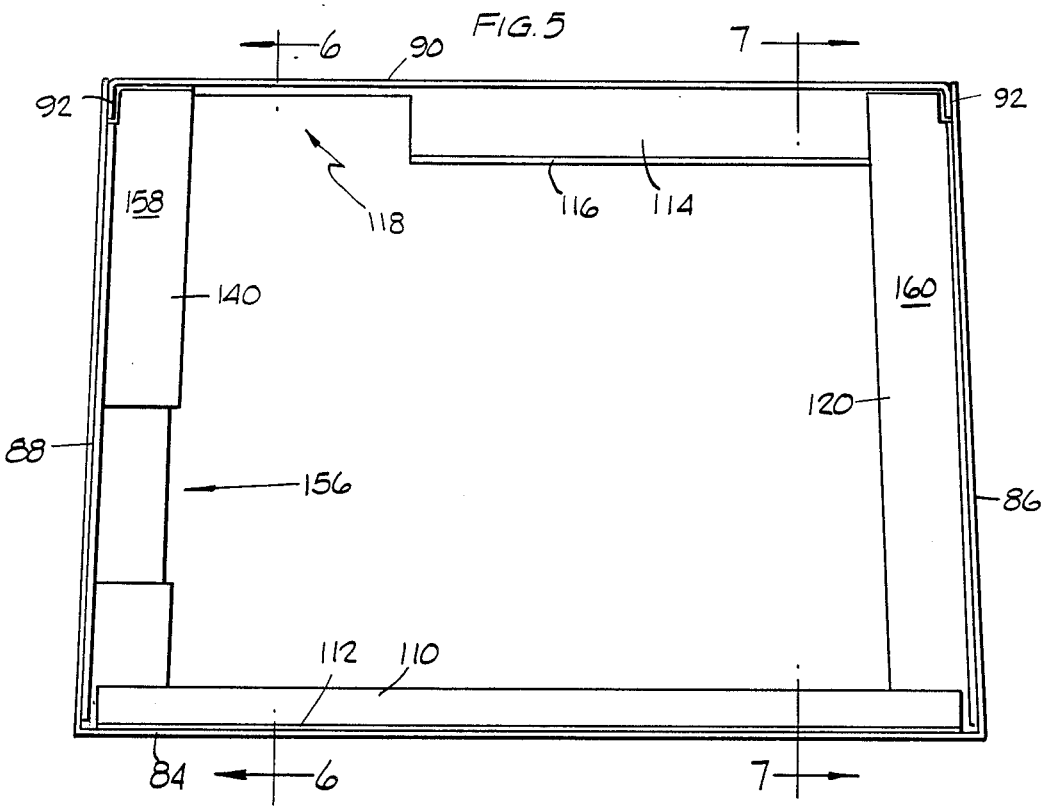
FIG. 5 is a top plan view of FIG. 4.
Figure 6:
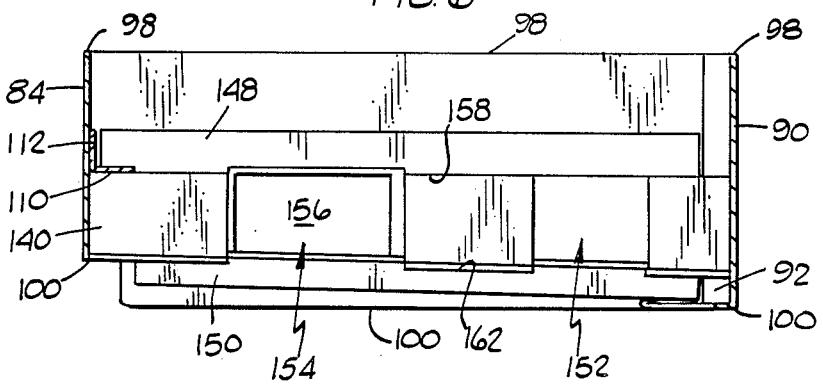
FIG. 6 is a cross-sectional view taken on the line 6—6 of FIG. 5.
Figure 7:
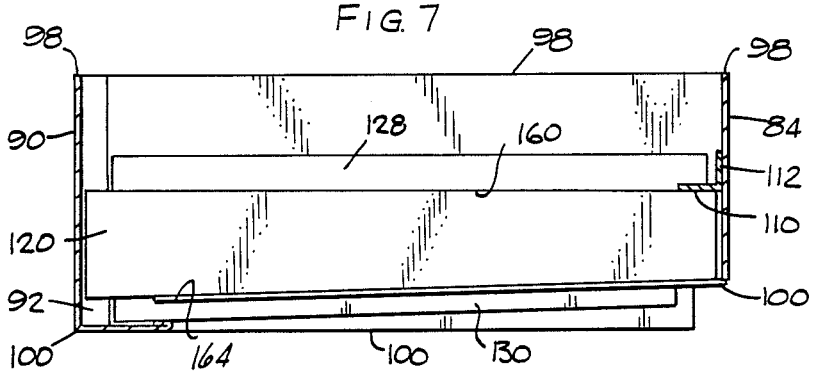
FIG. 7 is a cross-sectional view taken on the line 7—7 of FIG. 5.
Figure 8:
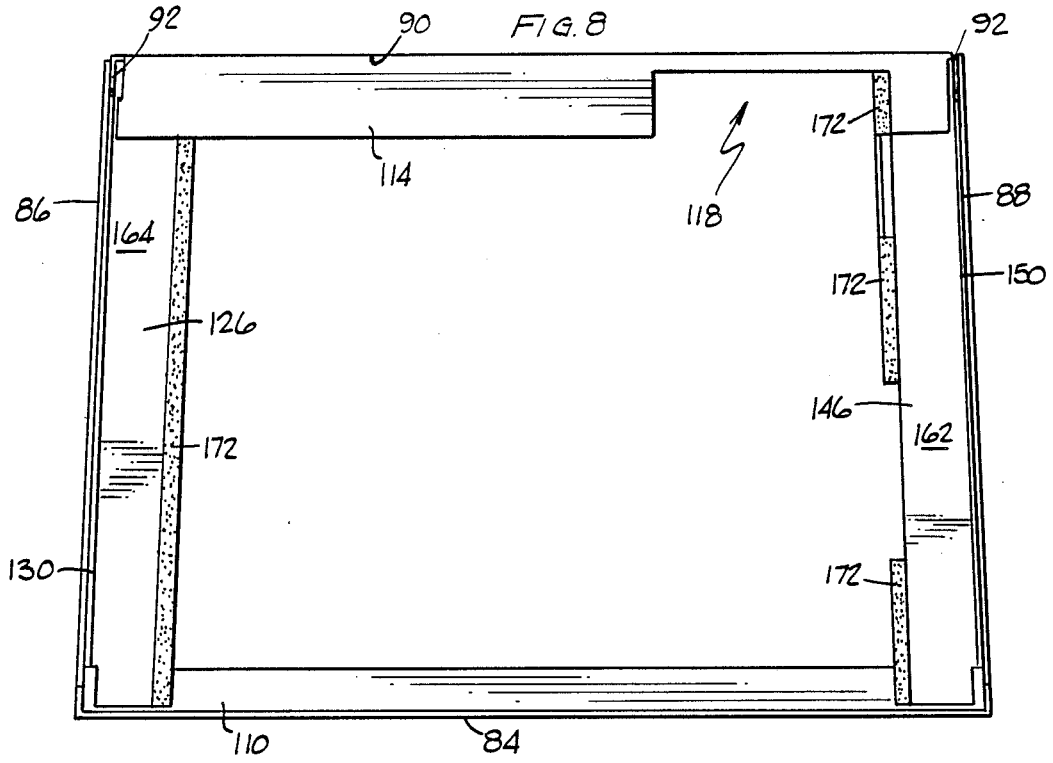
FIG. 8 is a bottom plan view of FIG. 4.

As illustrated in FIGS. 5 and 8, the length of the back wall 90 between the sidewalls 86 and 88 is shorter than the length of the front wall 84 between the sidewalls 86 and 88. The top sides 98, as illustrated in FIGS. 6 and 7, of the front wall 84, the sidewalls 86 and 88 and the back wall 90 lie in a common plane and the bottom sides 100 of the sidewalls 86 and 88 and the back wall 90 lie in a common plane. The upper surface 158 of the leg member 144 and the upper surface 160 of the leg member 124 lie generally in a common plane that is parallel to the common plane of the top sides 98 and spaced therebelow and adapted to support a bottom portion of a computer control unit so that the bottom portions of the computer control unit are within portions of front wall 84, the sidewalls 86 and 88 and the back wall 90. The bottom surface 162 of the leg portion 146 and the bottom surface 164 of the leg portion 126 lie in a common plane that is inclined at an angle relative to the common plane of the bottom sides 100. The combination of the shorter back wall 90 and the inclination of the bottom surfaces 162 and 164 permit the stacker unit to be placed on top of a computer control unit having a correspondingly shaped top portion so that the common plane of the upper surfaces 158 and 160 will be in a horizontal plane so as to support the other computer control unit in a level position.

Figure 9:
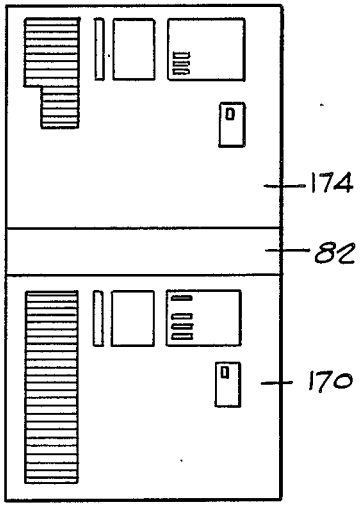
FIG. 9 is a front elevational view of the stacker unit of FIG. 4 in use.

The operation of the stacker unit 82 is illustrated in FIG. 9 wherein a stacker unit 82 is positioned on top of a computer control unit 170 s that the bottom surfaces 162 and 164 are in contact with upper portions of computer control unit 170. The folded back portion 116 of the flange 114 and the flange members 130 and 150 contact other portions of the computer control u it 170 to locate the stacker unit 82 in a proper position thereon. If desired, plastic anti-skid strips 172 may be placed on the bottom surfaces 162 and 164 to prevent relative movement between the stacker unit 82 and the computer control unit 170. The bottom portion of a second computer control unit 174 is then placed into contact with the upper surfaces 158 and 160 so that the one side 112, the flange members 128 and 148 and the upper portion of the inner surface 9 of the back wall 90 prevent relative movement between the stacker unit 82 and the second computer control unit 174.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. Apparatus for use in stacking one computer control unit of a certain type on top of another computer control unit of the same type comprising:

a frame having a central opening and comprising a plurality of walls comprising front and back walls and two sidewalls;

securing means for securing said plurality of walls together to form said open frame;

each of said walls and sidewalls having an outer surface, an inner surface, a top side and a bottom side;

reinforcing means secured to at least a plurality of said inner surfaces and extending for at least a substantial portion of the length thereof for adding strength to said open frame; wherein said reinforcing means comprises an angle member secured to said inner surface of said front wall and having a length substantially the same as the length of said front wall, a channel member secured to said inner surface of each of said sidewalls and having a length substantially the same as the length of each of said sidewalls, and a flange projecting inwardly from said bottom side of said back wall and having a length substantially the same as the length of said back wall;

said reinforcing means having a top surface and a bottom surface;

said bottom surface in contact with at least a portion of said one computer control unit;

said top surface in contact with at least a portion of said another computer control unit of the same type; and said plurality of walls and sidewalls and said reinforcing means being formed from sheet metal.

2. The invention as in claim 1 wherein:

said top sides of said plurality of walls lying in a common plane;

each of said channel members having a generally planar top surface; and said generally planar top surfaces lying in a common plane that is spaced from and parallel to said common plane of said top sides.

3. The invention as in claim 2 wherein:

said bottom sides of said sidewalls and said back wall lying in a common plane;

each of said channel members having a generally planar bottom surface; and said generally planar bottom surface lying in a common plane that is spaced from and inclined relative to said common plane of said bottom sides of said sidewalls and said back wall.

4. The invention as in claim 3 wherein:

each of said channel members having at least three walls in a U-shaped arrangement having a base and two integral legs extending therefrom and forming therewith a 90 degree relationship;

a flange portion extending outwardly from at least one of said legs; and securing means for securing each of said flange portions to one of said sidewalls.

5. The invention as in claim 4 wherein said securing means comprises:

welding.

6. The invention as in claim 1 wherein:

each of said channel members having at least three walls in a U-shaped arrangement having a base and two integral legs extending therefrom and forming therewith a 90 degree relationship;

a flange portion extending outwardly from each of said legs in opposite directions; and each of said flange portions being secured to an associated sidewall by welding.

7. The invention as in claim 6 wherein:

said front wall has a length greater than the length of said back wall.

8. The invention as in claim 7 wherein:

said top sides of said plurality of walls lying in a common plane;

each of said channel members having a generally planar top surface;

said generally planar top surfaces lying in a common plane that is spaced from and parallel to said common plane of said top sides;

said bottom sides of said sidewalls and said back wall lying in a common plane;

each of said channel members having a generally planar bottom surface; and said generally planar bottom surface lying in a common plane that is spaced from and inclined relative to said common plane of said bottom sides of said sidewalls and said back wall.

9. The invention as in claim 8 and further comprising:

access openings in at least one of said channel members; one of said sidewalls and said flange extending from said bottom side of said back wall to provide for electrical cable connections for said computer control units.

* * * * *